US005566827A

United States Patent [19]

Janhonen

[11] Patent Number: 5,566,827

[45] Date of Patent: Oct. 22, 1996

[54] BOOK PACKAGING CONTAINER

[75] Inventor: Tarmo Janhonen, Vantaa, Finland

[73] Assignee: Pussikeskusoy, Helsinki, Finland

[21] Appl. No.: 321,988

[22] Filed: Oct. 12, 1994

[30] Foreign Application Priority Data

Oct. 12, 1993 [FI] Finland ..... 934496

[51] Int. Cl.[6] ..... B65D 25/10

[52] U.S. Cl. ..... 206/424; 206/521

[58] Field of Search ..... 206/424, 521, 206/583, 591, 592, 594; 229/103.2, 103.3

[56] References Cited

U.S. PATENT DOCUMENTS

| | | | |
|---|---|---|---|
| 1,838,869 | 12/1931 | Rieb | 229/103.3 |
| 2,005,967 | 6/1935 | Berdan | 206/62 |
| 2,144,071 | 1/1939 | Loth | 206/424 |
| 3,180,607 | 4/1965 | Lee | 248/361 |
| 3,211,283 | 10/1965 | Hassler | 206/424 |
| 3,217,868 | 11/1965 | Champlin et al. | 206/424 |
| 3,442,372 | 5/1969 | Carmichael et al. | 206/46 |
| 3,598,233 | 8/1971 | Jasinover | 206/45.19 |
| 4,757,900 | 7/1988 | Misset et al. | 206/521 |
| 4,865,200 | 9/1989 | Sullivan et al. | 206/583 |

FOREIGN PATENT DOCUMENTS

| | | | |
|---|---|---|---|
| 225208 | 6/1987 | European Pat. Off. . | |
| 447282 | 9/1991 | European Pat. Off. . | |
| 2632926 | 12/1989 | France . | |
| 2680355 | 2/1993 | France | 229/103.3 |
| WO9304934 | 3/1993 | WIPO . | |

*Primary Examiner*—Jimmy G. Foster

*Attorney, Agent, or Firm*—Price, Heneveld, Cooper, DeWitt & Litton

[57] ABSTRACT

A book packaging container, comprising four walls (10), a floor (9) and cover flaps (11) which can be folded into a container closing cover after wrapping the books, said walls, floor and cover defining a space having a certain size and shape. The floor (9) of a container or a separate base sheet (3) laid upon the floor of a container is fitted with carton or cardboard flaps (5) whose bases are located adjacent to an edge (13) between the opposite end walls (10) and the floor (9) of a container. The flaps (5) have a length which only slightly less than that of the container, whereby the ends of said flaps (5) can be fastened in an overlapping (7) fashion against each other on top of a bundle of books (6).

20 Claims, 2 Drawing Sheets

BOOK PACKAGING CONTAINER

FIELD OF THE INVENTION

The present invention relates to a book packaging container, comprising four walls, a floor and cover flaps which can be folded into a container closing cover after wrapping the books, said walls, floor and cover defining a space having a certain size and shape.

BACKGROUND OF THE INVENTION

Book clubs, for example, mail books to their subscribers in such book packaging containers or parcels. The size of books to be mailed and the thickness of book bundles vary and, thus, more or less empty space is left between a bundle of books and the walls of a container. However, it is necessary to eliminate the movement of books inside the container as effectively as possible for preventing damage to the books as a result of rubbing against each other and colliding against the walls of a container. Hence, it is prior known to furnish a container with various paddings. Those are nevertheless inconvenient and often also littering. Prior known is also a plastic bag which expands through the action of chemicals (instafoam). The use of such a bag is also inconvenient and disposal of the bag creates an environmental problem. In addition, threading of a plastic wrapper strip between the floor flaps is also prior known for binding a pile of books with the wrapper strip into an integral bundle against the floor. However, the further handling of a package is inconvenient since the plastic must be separated therefrom before the cardboard material can be recycled or incinerated. Another drawback is that the wrapper strip must be previously inserted in the container forming machine. Yet, most of the containers are manufactured by using machines which lack this feature and, hence, those who use the containers have to settle with the above-mentioned paddings.

An object of the invention is to provide an improved book packaging container, wherein the elimination or restriction of movements for a bundle of books of varying dimensions can be effected without the above drawbacks.

SUMMARY OF THE INVENTION

This object is achieved by means of the invention in such a manner that the floor of a container or a separate base sheet laid upon the floor of a container is fitted with carton or cardboard flaps whose bases are located adjacent to an edge between the opposite end walls and the floor of a container, said flaps having a length which is more than the sum of the half-height and the half-length of a container but less than the length of a container, whereby the ends of the flaps can be fastened in an overlapping fashion against each other on top of a bundle of books.

A preferred embodiment of the invention, which during the course of packing can be affixed as a supplement to a conventional cardboard container, is characterized in that a separate base sheet made of carton or cardboard is of a size that matches the floor of a container, such that the base sheet abuts with its edges against the walls surrounding the floor of a Container, and that the bases of said flaps join the base sheet at a small distance from the ends of the base sheet.

These type of supplemental base sheets can be manufactured to match various container sizes simply in such a manner that said flaps consist of the same continuous web of carton or cardboard as said base sheet and that said small distance is provided by double-folding the web into end or flank reinforcements for the base sheet, the superimposed plies being glued together at said reinforcements.

Since the flaps and the base sheet bind the books into an integral bundle whose lateral movements are eliminated by the base sheet, said base sheet need not necessarily be glued securely to the floor of a container. However, if the supplement consists of very thin carton or if the vertical movement of a bundle Of books should also be eliminated, it is preferred that the base sheet be glued securely to the floor of a container.

A solution, which is capable of being manufactured both during the course of assembling a container and as a supplement to be affixed to a finished container, is characterized in that said separate base sheet and said flaps are made of single corrugated cardboard whose smooth face is fastened to the inner surface of the floor of a container.

A solution, which is only capable of being manufactured during the course of assembling a container, is characterized in that said flaps are made of the same continuous cardboard material as the container and are formed from the extensions of floor closing flaps.

In order to facilitate mechanical closing of the flaps it is preferred that the flaps be different in length.

In view of a closing operation effected both manually and mechanically, it is preferred that the outer edge adjacent to the end flank of the shorter flap be provided with an adhesive.

BRIEF DESCRIPTION OF THE DRAWINGS

Three different embodiments of the invention will now be described in more detail with reference made to the accompanying drawings, in which.

DESCRIPTION OF THE PREFERRED EMBODIMENTS

Figure 1:
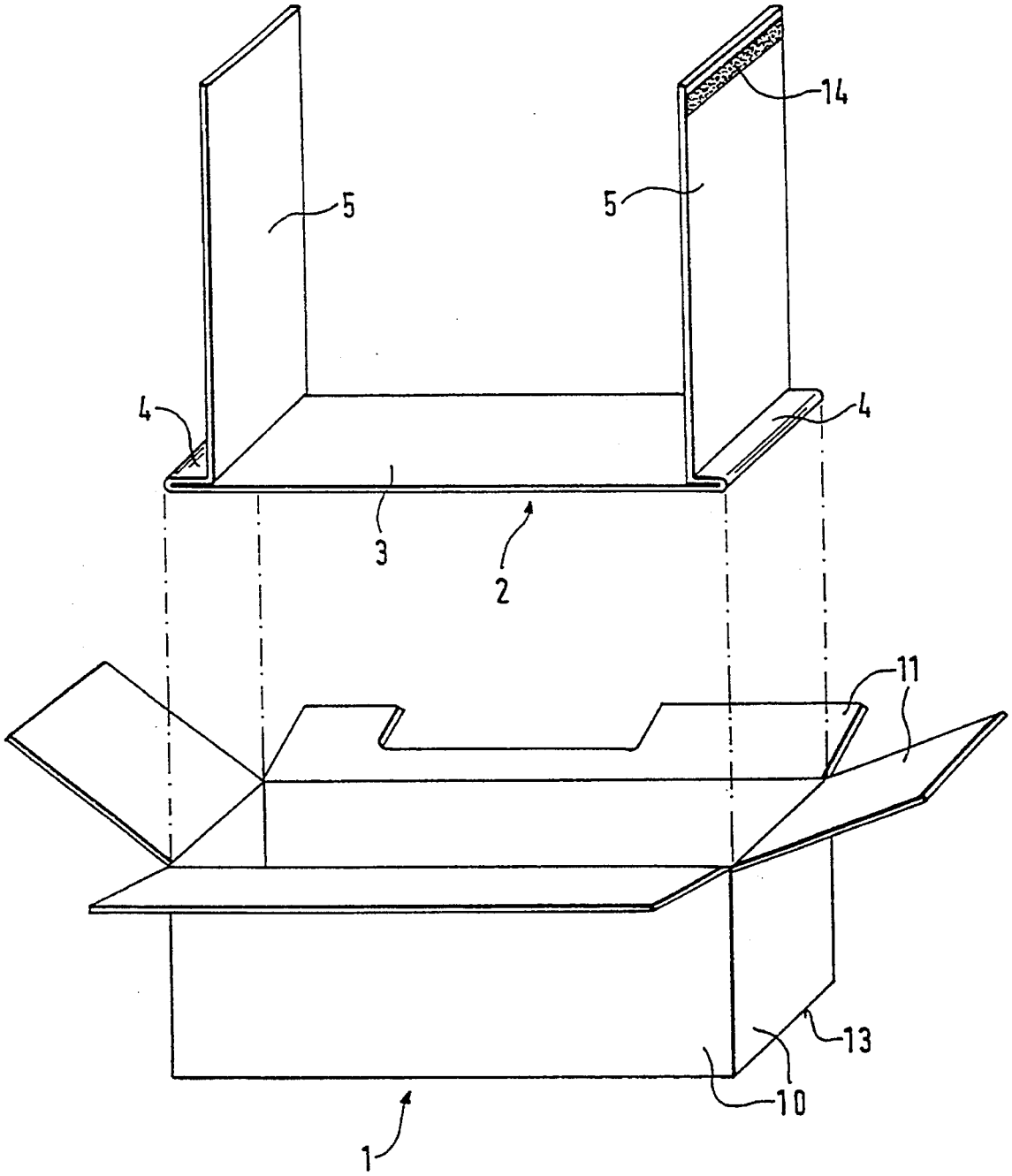
FIG. 1 is a perspective view showing a packaging container according to a first embodiment of the invention prior to fitting an inner wrapper 2 in a container 1.
Figure 2:
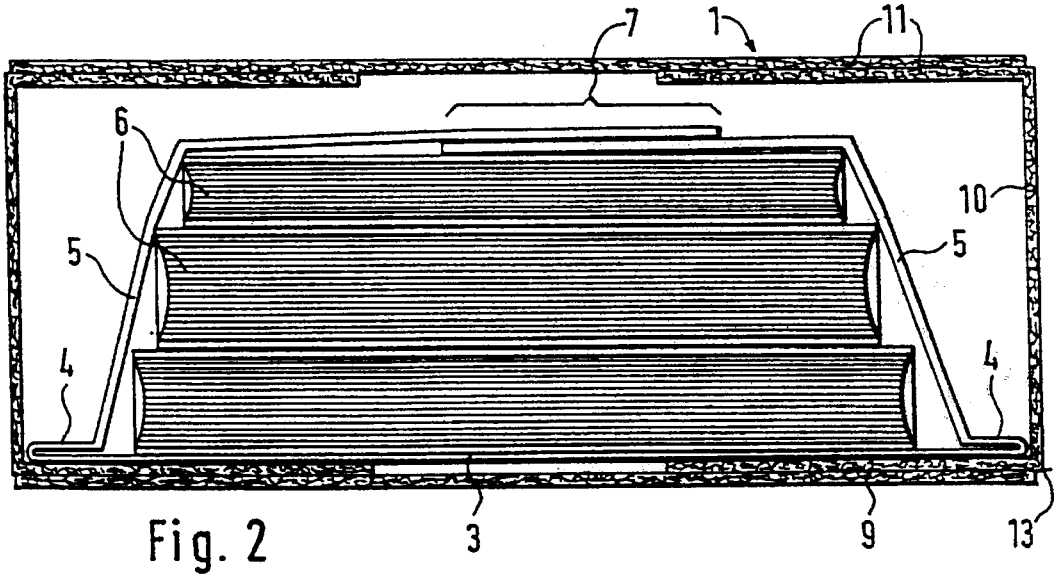
FIG. 2 is a vertical section showing the packaging container of FIG. 1 after a packing operation.

The packaging container shown in FIGS. 1 and 2 include two separate sections, namely a container 1 and a wrapper unit 2, possibly coming from different manufacturers.

The container is made e.g. of corrugated cardboard and includes four walls 10, a floor 9 and cover flaps 11. The floor 9 may also consist of four flaps the same way as the cover.

The wrapper unit 2 comprises a base sheet 3 and flaps 5, which are made of the same continuously extending carton or cardboard web as the base sheet 3. In the end areas of the base sheet 3, however, the web is double-folded and glued into end reinforcements 4 for the base sheet 3. At the same time, this provides a small distance equal to the width of reinforcements 4 between the base of flaps 5 and the ends of sheet 3.

The flaps 5 must have a sufficient length to enable them to extend in an overlapping fashion over the top of a bundle of books 6 placed upon the base sheet 3, as shown in FIG.

2 with reference numeral 7. However, the flaps 5 must be shorter than the length of container 1 and at least one of the flaps 5 must be shorter than the distance between the bases thereof to enable the flaps 5 to rest tightly on top of each other upon the base sheet 3. Thus, the wrapper units 2 can be stored as tight bundles for delivering such units mechanically therefrom into a container while opening the flaps 5. Prior to inserting aunit 2 into a container 1, the adhesive points are sprayed on the outer face of the base sheet 3 or on the inner face of the container floor 9.

One of the flaps is longer than the other and thus, in a mechanical closing process, with the flaps folding almost simultaneously, the shorter flap will always end up underneath. Thus, the outer face of its end portion may be provided with an adhesive tape 14 or adhesive points sprayed in the packaging machine.

The size of base sheet 3 is substantially equal to the inside dimension of container floor 9, whereby the base sheet 3 abuts against the walls 10 surrounding the container floor. Hence, the unit 2 need not be glued to the container floor provided that said unit 2 is made of a rigid carton or cardboard. The distance of the bases of flaps 5 from the end walls 10 ensures that books 6 that are typically shorter than the length of a container will also be secured by the flaps 5 on the container floor.

Figure 3:
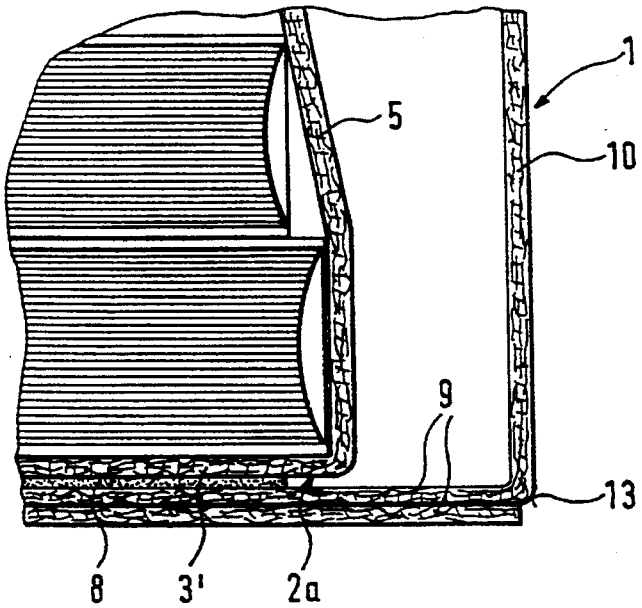
FIG. 3 is a vertical section showing a bottom corner in a packaging container according to a second embodiment of the invention.

The case of FIG. 3 differs from what is described above in that the material of an inner wrapper 2*a* comprises a single corrugated cardboard which provides a base sheet 3', which is fastened with an adhesive 8 to a container floor 9 and, thus, there is no need for end flanks abutting against the end walls 10. However, if the inner wrapper 2*a* is supplied as a supplement separate from the container, it is preferably provided with end folds 4 abutting against the container end walls 10, as in the embodiment of FIGS. 1 and 2.

Figure 4:
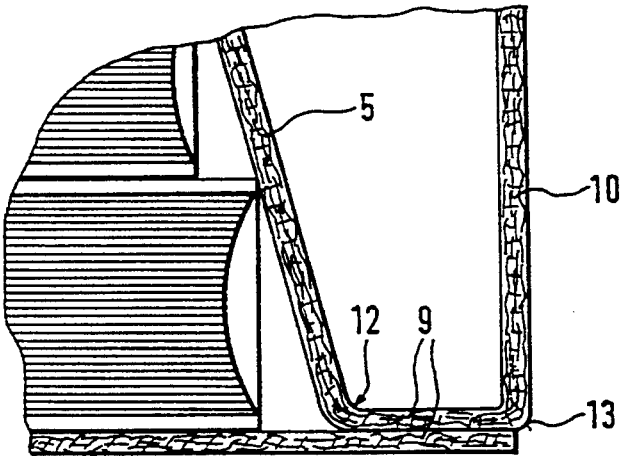
FIG. 4 shows a third embodiment of the invention the same way as FIG. 3.

The embodiment of FIG. 4 differs from those described above in that the flaps 5 are made of the same continuous cardboard material as the container 1 and are formed from the extensions of closing flaps for the floor 9. In order to locate the bases of flaps 5 also in this embodiment at a small distance from an edge 13 between the end wall 10 and the floor 9, it is possible to provide a bending crease 12 at the base of flap 5. Between the edge 13 and the bending crease 12 said floor plies 9 can be glued to each other for bracing the floor edge and corners of a container. In the cases of FIGS. 3 and 4, the dimensioning and operation of flaps 5 can be otherwise equal to what is described in conjunction of FIGS. 1 and 2.

I claim:

1. A book packaging container, comprising four walls (10), a floor (9) and cover flap (11) which can be folded into a container closing cover after wrapping the books, said walls, floor and cover defining a space having a certain size and shape, a separate base sheet (3) laid upon said floor of said container having cardboard flaps (5) including bases located adjacent to an edge (13) between opposite ones of said walls (10) and said floor (9) of said container, said flaps also each having an end and a length which is more than the sum of the half-height and the half-length of said container but less than the length of said container, whereby said ends of said flaps (5) are adapted to be fastened in an overlapping (7) fashion against each other on top of a bundle of books (6), and wherein said separate base sheet (3) is made of cardboard and has a size that matches the floor of said container (1), such that said base sheet (3) abuts with its edges against said walls (10) surrounding said floor of said container, and that said bases of said flaps (5) join said base sheet (3) at a small distance from the ends of said base sheet (3).

2. A book packaging container as set forth in claim 1, wherein said flaps (5) consist of the same continuous web of cardboard as said base sheet (3) and that said small distance is provided by double-folding said web into end reinforcements (4) for said base sheet, said end reinforcements being superimposed over and against and glued to said base sheet.

3. A book packaging container as set forth in claim 2, wherein said base sheet (3) is glued securely to said floor (9) of said container (1).

4. A book packaging container as set forth in claim 3 wherein said base sheet (3) and said flaps (5) comprise a wrapper unit formed from corrugated cardboard and fitted inside said container.

5. A book packaging container as set forth in claim 4 wherein said flaps are different in length.

6. A book packaging container as set forth in claim 3 wherein said flaps are different in length.

7. A book packaging container as set forth in claim 2 wherein said separate base sheet (3') and said flaps (5) are made of a single corrugated cardboard having a smooth face fastened to the inner surface of said container floor (9).

8. A book packaging container as set forth in claim 7 wherein said flaps are different in length.

9. A book packaging container as set forth in claim 2 wherein said sheet (3) and said flaps (5) comprise a wrapper unit formed from corrugated cardboard and fitted inside said container.

10. A book packaging container as set forth in claim 2 wherein said separate base sheet (3') and said flaps (5) are made of a single corrugated cardboard having a smooth face fastened to the inner surface of said container floor (9).

11. A book packaging container as set forth in claim 2 wherein said flaps are different in length.

12. A book packaging container as set forth in claim 1, wherein said base sheet (3) is glued securely to said floor (9) of said container (1).

13. A book packaging container as set forth in claim 1 wherein said base sheet (3) and said flaps (5) comprise a wrapper unit formed from corrugated cardboard and fitted inside said container.

14. A book packaging container as set forth in claim 1 wherein said base sheet (3) and said flaps (5) comprise a wrapper unit formed from corrugated cardboard and fitted inside said container.

15. A book packaging container as set forth in claim 1 wherein said separate base sheet (3') and said flaps (5) are made of a single corrugated cardboard having a smooth face fastened to the inner surface of said container floor (9).

16. A book packaging container as set forth in claim 1 wherein said flaps are different in length.

17. A book packaging container as set forth in claim 1 wherein said flaps are different in length.

18. A book packaging container comprising four walls, a floor, and at least one cover flap for folding into a container closing cover, said container including book securing flaps extending upwardly within said container from positions spaced inwardly from opposed ones of said walls over a base sheet fitted on said container floor, said book securing flaps including bases located adjacent to an edge between opposite ones of said walls and said floor, said book securing flaps each having an end and a length sufficient to extend upwardly and over at least one book when placed within said container between said book securing flaps such that said book securing flap ends will overlap and can be fastened to secure the book within said container, said base sheet having edges which abut said walls surrounding said floor of said container, and said bases of said book securing flaps join said base sheet at a small distance from the ends of said base sheet.

19. The container of claim 18 wherein said container and book securing flaps are formed from cardboard.

20. The container of claim 19 wherein said book securing flaps each have a different length.

* * * * *

UNITED STATES PATENT AND TRADEMARK OFFICE

CERTIFICATE OF CORRECTION

PATENT NO. : 5,566,827
DATED : October 22, 1996
INVENTOR(S) : Tarmo Janhonen

It is certified that error appears in the above-identified patent and that said Letters Patent is hereby corrected as shown below:

Item: [73] Assignee;

"Pussikeskusoy" should be –Pussikeskus Oy–.

Column 2, line 9;

"Of" should be –of–.

Column 3, line 8;

"aunit" should be –a unit–.

Column 6, line 1;

"19" should be –18–.

Signed and Sealed this

Twenty-second Day of April, 1997

Bruce Lehman

BRUCE LEHMAN

*Commissioner of Patents and Trademarks*

*Attest:*

*Attesting Officer*

UNITED STATES PATENT AND TRADEMARK OFFICE

CERTIFICATE OF CORRECTION

PATENT NO. : 5,566,827
DATED : October 22, 1996
INVENTOR(S) : Tarmo Janhonen

It is certified that error appears in the above-indentified patent and that said Letters Patent is hereby corrected as shown below:

On the title page, item:

[73] Assignee:

"Pussikeskusoy" should be –Pussikeskus Oy–.

Abstract, line 9:

After "which" insert –is–.

Signed and Sealed this

Twentieth Day of May, 1997

*Attest:*

*Attesting Officer*

Bruce Lehman

BRUCE LEHMAN

*Commissioner of Patents and Trademarks*